US006533194B2

(12) United States Patent
Marsh et al.

(10) Patent No.: US 6,533,194 B2
(45) Date of Patent: Mar. 18, 2003

(54) SHOWER HEAD

(75) Inventors: Windsor B. Marsh, Cleveland, WI (US); Donald N. Jursich, Crystal Lake, IL (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 09/748,517

(22) Filed: Dec. 22, 2000

(65) Prior Publication Data

US 2001/0008256 A1 Jul. 19, 2001

Related U.S. Application Data

(62) Division of application No. 09/482,467, filed on Jan. 13, 2000.

(51) Int. Cl.[7] ..... B05B 1/34

(52) U.S. Cl. ..... 239/383; 239/381; 239/382; 239/538; 239/560

(58) Field of Search ..... 239/436, 437, 239/446, 447, 538, 540, 556, 558, 559, 565, 567, 579, 581.1, 380, 382, 381, 383, 560

(56) References Cited

U.S. PATENT DOCUMENTS

| | | | | |
|---|---|---|---|---|
| 4,254,914 A | | 3/1981 | Shames et al. | |
| 4,398,669 A | | 8/1983 | Fienhold | |
| 4,629,125 A | | 12/1986 | Liu | |
| 4,838,486 A | | 6/1989 | Finkbeiner | |
| 5,172,862 A | | 12/1992 | Heimann et al. | |
| 5,201,468 A | | 4/1993 | Freier et al. | |
| 5,316,216 A | | 5/1994 | Cammack et al. | |
| 5,356,077 A | | 10/1994 | Shames et al. | |
| 5,397,064 A | | 3/1995 | Heitzman | |
| 5,398,872 A | | 3/1995 | Joubran | 239/446 |
| 5,405,089 A | | 4/1995 | Heimann et al. | 239/559 |
| 5,433,384 A | | 7/1995 | Chan et al. | |
| 5,441,075 A | | 8/1995 | Clare | |
| 5,476,225 A | | 12/1995 | Chan | |
| 5,577,664 A | | 11/1996 | Heitzman | |
| 5,647,537 A | | 7/1997 | Bergmann | |
| 5,697,557 A | | 12/1997 | Blessing et al. | |
| 5,699,964 A | | 12/1997 | Bergmann et al. | |
| 5,718,380 A | | 2/1998 | Schorn et al. | |
| 5,765,760 A | | 6/1998 | Kuo | |
| 5,772,120 A | | 6/1998 | Huber | |
| 5,833,138 A | | 11/1998 | Crane et al. | |
| 5,860,596 A | | 1/1999 | Kolt | |
| 5,860,599 A | * | 1/1999 | Lin | 239/380 |
| 5,862,985 A | * | 1/1999 | Neibrook et al. | 239/428.5 |
| 5,884,847 A | | 3/1999 | Christopher | |
| 5,918,816 A | | 7/1999 | Huber | |
| 5,927,333 A | | 7/1999 | Grassberger | |
| 5,961,046 A | * | 10/1999 | Joubran | 239/446 |
| 6,076,747 A | * | 6/2000 | Ming-Yuan | 239/383 |

FOREIGN PATENT DOCUMENTS

| | | |
|---|---|---|
| DE | 44 15 785 | 11/1995 |
| EP | 461 089 | 12/1991 |
| EP | 836 888 | 4/1998 |
| EP | 900 597 | 3/1999 |

* cited by examiner

*Primary Examiner*—Christopher Kim
(74) *Attorney, Agent, or Firm*—Quarles & Brady LLP

(57) ABSTRACT

Shower heads are disclosed providing for varying types of spray. One spray head provides three different spray patterns, with two of the patterns having pulsing impellers which can pulse at different speeds from each other.

2 Claims, 14 Drawing Sheets

FIG. 11
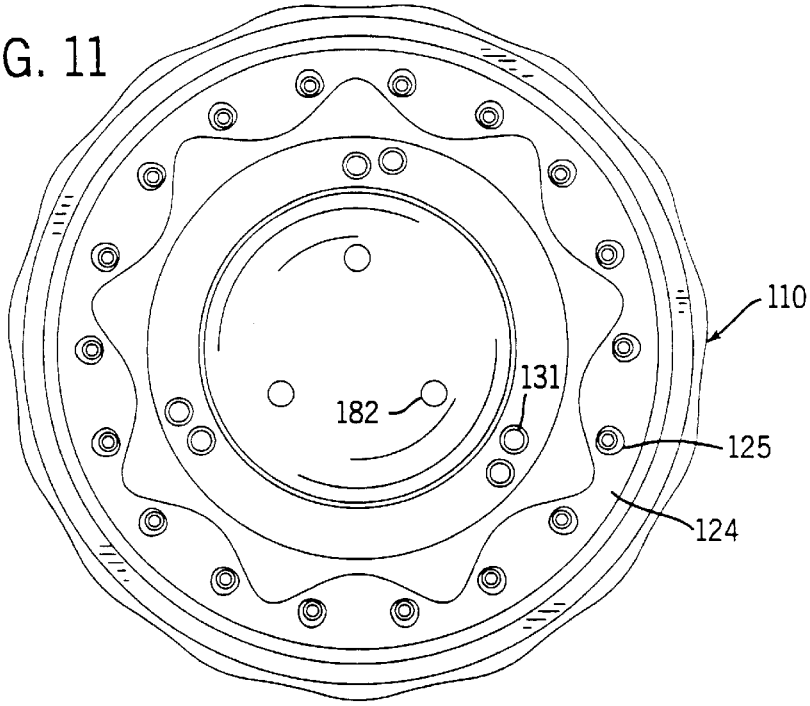
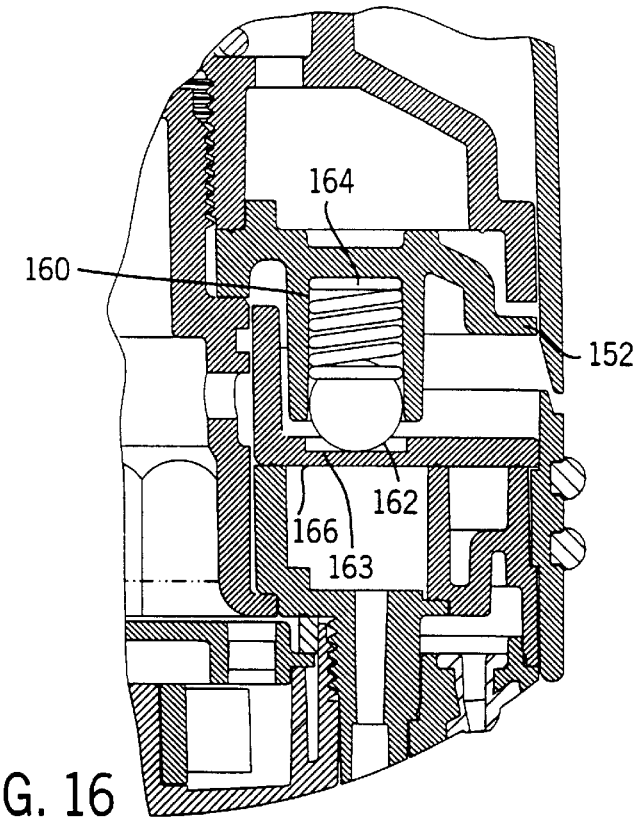
FIG. 16

SHOWER HEAD

CROSS-REFERENCE TO RELATED APPLICATIONS

This is a divisional application of U.S. patent application Ser. No. 09/482,467, filed Jan. 13, 2000.

STATEMENT REGARDING FEDERALLY SPONSORED RESEARCH OF DEVELOPMENT

Not Applicable

BACKGROUND OF THE INVENTION

This invention relates to shower heads which allow for selection of a variety of discharge spray patterns and intensities.

There are a wide variety of shower heads which are used in conjunction with plumbing installations. They provide a variety of spray patterns with different flow rates, as well as pulsated sprays. One such apparatus is described in U.S. Pat. No. 5,201,468 where the head has three different flow paths to provide a central, outer and middle spray pattern. There is a pulsating turbine in communication with the middle spray pattern.

In U.S. Pat. No. 4,398,669 a rotatable housing is provided with a small opening and a large opening, with the large opening feeding water to rotate a valve and cause pulsing of the water from orifices. U.S. Pat. No. 5,862,985 shows pulsating spray channels for fluid communication with pulsating spray selector holes for varying flow to the pulsating spray assembly.

U.S. Pat. Nos. 5,397,064 and 5,577,664 disclose pulsating shower heads each with a pair of impellers. However, only one of the impellers causes a pulsation of water flow.

Notwithstanding this variety of options in shower heads, there is nevertheless a desire for further variety. For example, it is preferred to have a set of spray apertures which can provide an outlet of pulsed water or optionally non-pulsed water (through the same apertures), along with a second set of spray apertures which provides only non-pulsed water.

Another desired feature (the subject of this divisional) would be to provide multiple impellers that provide concentric pulsing through two sets of pathways, with the pulsing being at different rates, along with a non-pulsing separate third pathway.

Yet another desired feature would be a shower head having three concentric rings of spray options, where none are in communication with an impeller and the central spray pattern can provide a more forceful spray out any given nozzle than the outer and middle spray patterns.

BRIEF SUMMARY OF THE INVENTION

In one embodiment the invention provides a shower head. It has an inlet assembly having a portion for connection to a fluid supply at a first end, and an outlet assembly abutting the inlet assembly opposite the first end and being rotatably attached thereto.

The outlet assembly includes a housing positioned opposite the inlet assembly, and a diverter member in the housing. The diverter member includes three separate passages, the second passage being of a smaller cross section than the first passage. There is also a face plate member connected to the housing. The face plate member has two sets of fluid passageways therethrough. A first of the sets of passageways is capable of being in communication with either the first or the second passages, and the second of the sets of passageways is capable of being in communication with the third passage.

There is also an impeller positioned between the first of the sets and the first passage. When the first passage is in communication with the first set of passageways, and water is passed through the shower head, the impeller will spin. When the second passage is in communication with the first set (and water is passed through the shower head) the impeller will not spin. A consumer can therefore select a pulsing central flow at high force, or a more gentle non-pulsing central flow (e.g. to clean off the face), or a more diffuse spray to wash soap off the rest of the body.

In preferred forms flexible nozzles are positioned in the passageways, there is a seal member surrounding the first and second passages, the first set of passageways are positioned radially inward from the second set of passageways, and the diverter member includes a raceway for accommodating a detent member.

In another embodiment (the subject of this divisional) there is a shower head that has an inlet assembly with a first chamber therein, a means for coupling the first chamber to a fluid supply, and an exit from the first chamber. There is also an outlet assembly abutting the inlet assembly and being rotatably attached thereto. The outlet assembly has a body having an inlet positionable to communicate with the exit when the outlet assembly is rotated into different positions with respect to the inlet assembly. The body also has a discharge section in which outlets are positioned.

There is also a face plate member connected to the body. The face plate member has three sets of fluid passageways therethrough. The first set is a radially inward set. The second set is a radially middle set. The third set is a radially outward set.

Also provided are a first rotatable impeller positioned between a first outlet and the first set of passageways, and a second rotatable impeller positioned between a second outlet and the second set of passageways. When an outlet of the body is in communication with the first set of passageways and water is passed through the shower head, the first impeller will spin. Similarly, when an outlet of the body is in communication with the second set of passageways and water is passed through the shower head, the second impeller will spin. Water can also pass through the third set of passageways when an outlet of the body is in communication with the third set. In a preferred form the head is connected to a hand held shower handle.

In this form of the invention the two different impellers can cause pulsing at different rates. There is also the option of a non-pulsed flow. This provides increased massaging flexibility.

In yet another embodiment there is provided a shower head. It has an inlet assembly with a first chamber therein, a means for coupling the first chamber to a fluid supply, and an exit from the first chamber. There is also an outlet assembly abutting the inlet assembly and being rotatably attached thereto.

The outlet assembly has a body with an inlet positionable to communicate with the exit when the outlet assembly is rotated into different positions with respect to the inlet assembly. The body also has a discharge section in which outlets are positioned.

There is also a face plate member connected to the body. The face plate member has three sets of fluid passageways therethrough. The first set is a radially inward set constructed and arranged to provide water at a first force level for a given volume of water passing through the head. The third set is a radially outward set constructed and arranged to provide water at a third force level which is less than the first force for said given volume of water passing through the head. The second set is a radially middle set constructed and arranged to provide water at a second force level which is less than the first force level and greater than the third force level for said given volume of water passing through the shower head. The shower head is further characterized in that it does not have any impeller in fluid communication with the face plate. In judging force levels for a set for this purpose, one looks to the force of the water exiting the nozzle of the set with the highest force level.

This embodiment permits water to exit from three different concentric arrays, with varying levels of force. No impeller is required.

The invention thus provides a variety of different options for a shower head. The assembly is relatively inexpensive to produce and manufacture. Further, repair of the assembly is quite easy.

The advantages of the invention therefore include providing shower heads of the above kind which:

a. can provide a multiplicity of spray patterns;

b. can provide a variety of flow rates;

c. are easily installed and maintained;

d. are adapted to be employed in conjunction with both wall mounted fluid supplies and hand held shower outlets.

These and still other advantages of the invention will be apparent from the description which follows. In the detailed description below, preferred embodiments of the invention will be described with reference to the accompanying drawings. These embodiments do not represent the full scope of the invention. Rather the invention may be employed in other embodiments. Reference should therefore be made to the claims herein for interpreting the breadth of the invention.

BRIEF DESCRIPTION OF THE DRAWINGS

FIG. 11 is a view similar to FIG. 2, albeit of a second embodiment of the present invention;

FIG. 16 is a view taken along line 16—16 of FIG. 13;

DETAILED DESCRIPTION OF THE INVENTION

Figure 1:
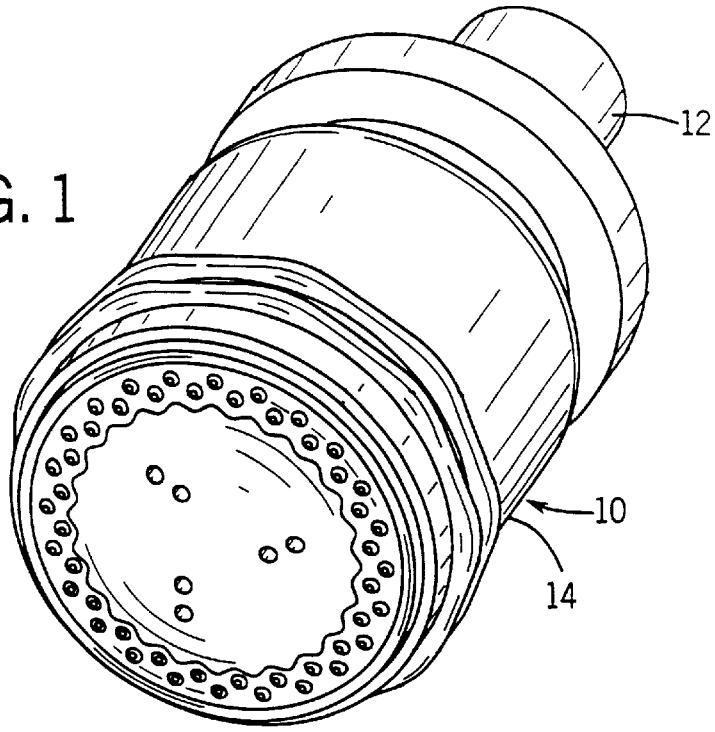
FIG. 1 is a top perspective view of a first shower head of the present invention.
Figure 2:
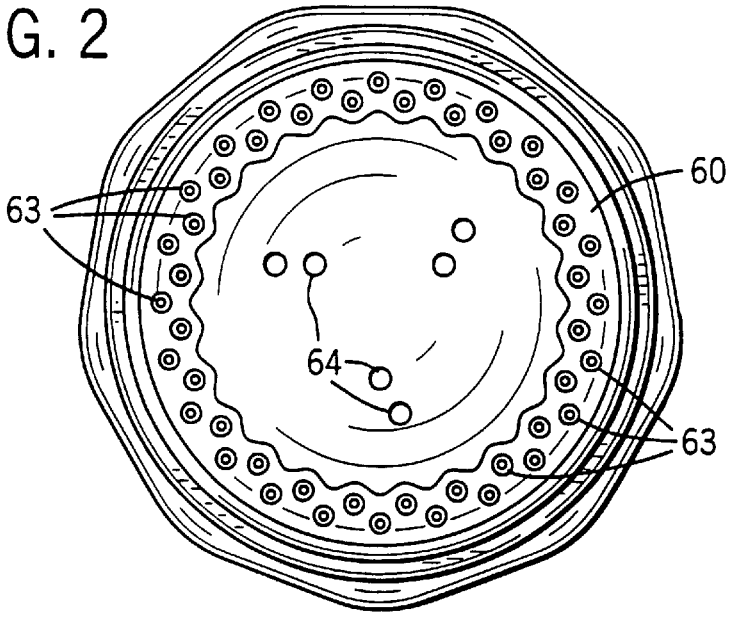
FIG. 2 is an end view of the outlet end of the shower head shown in FIG. 1.
Figure 3:
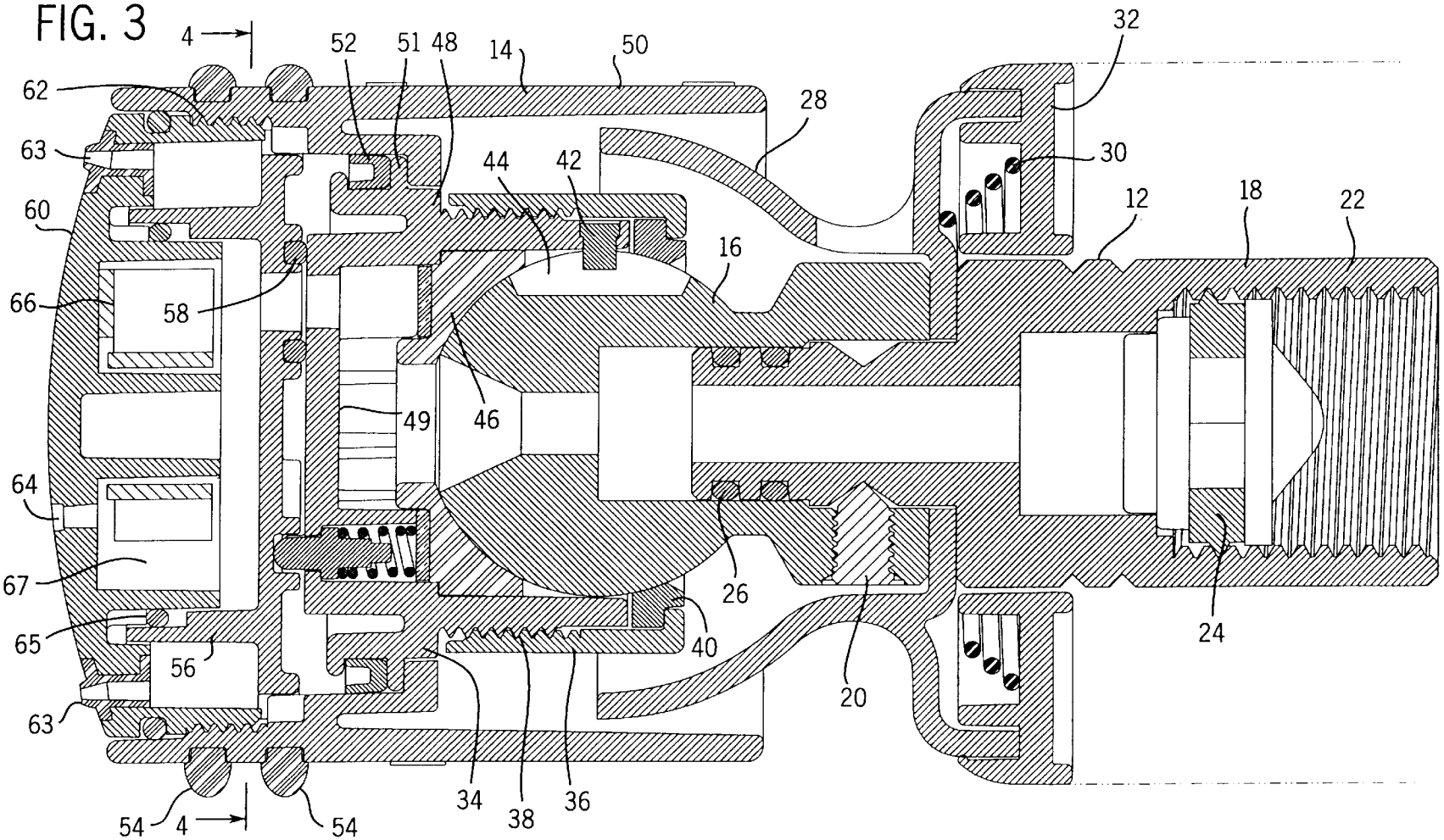
FIG. 3 is a longitudinal sectional view of the FIG. 1 shower head.

Referring first to FIGS. 1–3, a shower head generally 10 represents a first embodiment of the present invention and includes an inlet assembly 12 and an outlet assembly 14. The head can select between two different spray patterns by rotating outlet assembly 14 with respect to the inlet assembly, and as will be described one of these can be either pulsating or not.

The inlet assembly 12 has a metal ball joint 16 to which is connected tubular member 18 by means of set screw 20. O-ring seals 26 are placed therebetween. Tubular member 18 is internally threaded such as at 22, and can have a screen filter 24 placed therein.

Collar 28 is connected between the ball joint 16 and the tubular member 18. It includes a spring 30 and a closure ring 32 and provides for connection to a fluid supply. Another collar 36 surrounds the ball joint 16 and a seal 40 is placed therebetween. A pivot 42 extends into cutout 44 on the ball joint 16 to provide for a pivoting of the head 10. Inlet member 48 is connected to collar 36 by the threads 38 and has an endwall 49 and a flange 51.

Outer shell or housing 50 rides over inlet member 48 and is retained by flange 51 of inlet member 48. A suitable seal 52 is placed between inlet member 48 and shell 50. Grip rings 54 are disposed on the outside of shell 50 for the purpose of assisting rotation of shell 50. A diverter member 56 is disposed between inlet member 48 and face plate 60 to rotate therewith. It is connected to shell 50 by the threads 62. Face plate 60 has nozzles 63 and 64, and there is a seal 65 placed between the face plate and the diverter 56. An impeller 66 is rotatably mounted in chamber 67 of face plate 60.

Figure 4:
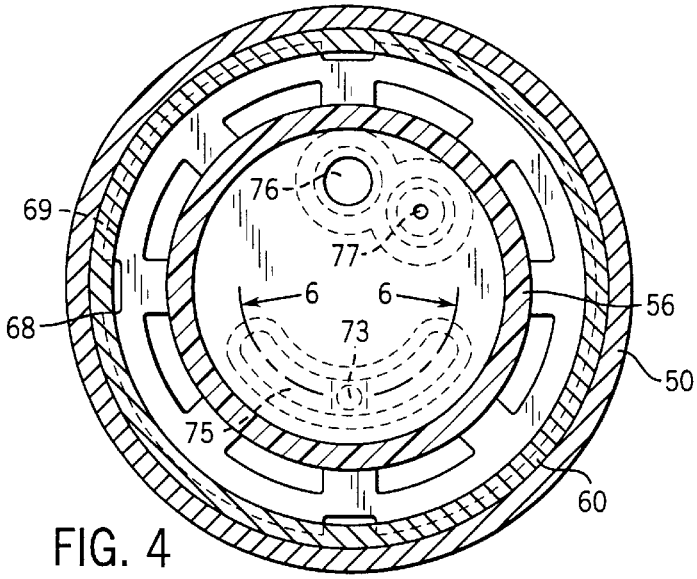
FIG. 4 is a sectional view taken along line 4—4 of FIG. 3.
Figure 6:
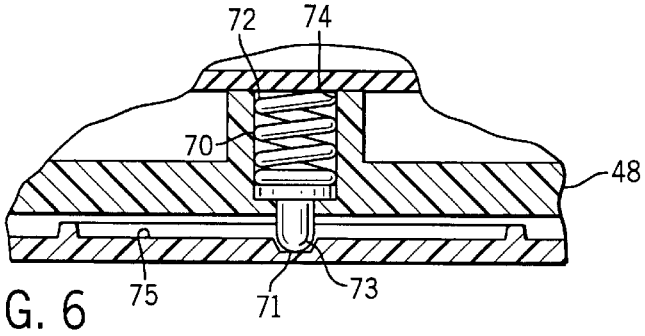
FIG. 6 is a sectional view taken along line 6—6 of FIG. 4.
Figure 5:
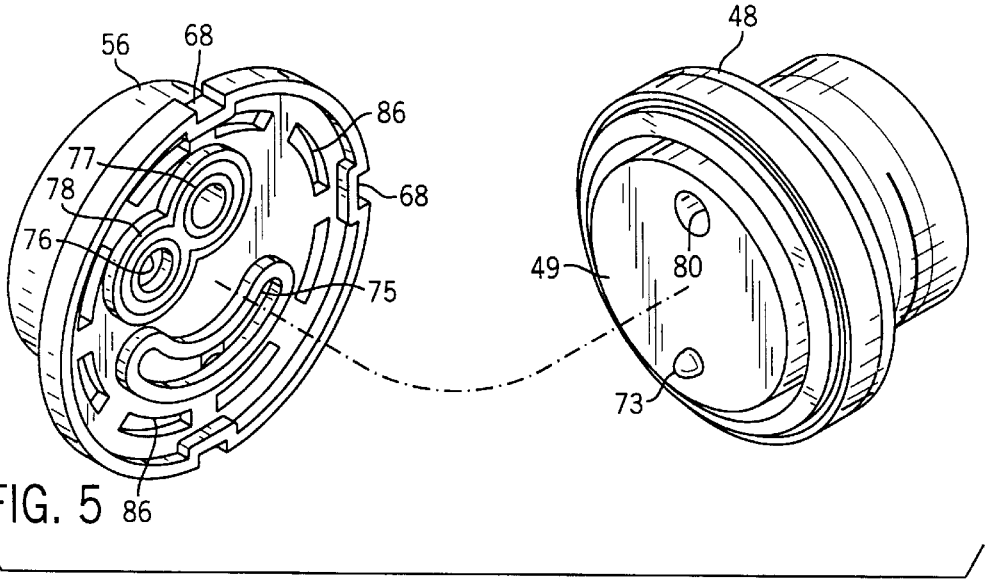
FIG. 5 is a schematic perspective view of an inlet member and diverter of the FIG. 1 shower head.

Referring to FIGS. 4–5, it is seen that diverter 56 is connected to shell 50 by the grooves 68 on the diverter and the tongues 69 extending from the shell. A detent mechanism 70 is housed in the member 48 and includes a compartment 72 for a biased detent 73 and the spring 74. The detent extends from inlet member 48 and into the raceway 75 on the diverter 56. This aids in the rotation of the diverter 56 with respect to the inlet member 48. A central locating notch is also provided at 71.

As best seen in FIG. 4, there is a large passage 76 and a small passage 77 extending through diverter 56, as well as a seal surrounding the passages.

Figure 7:
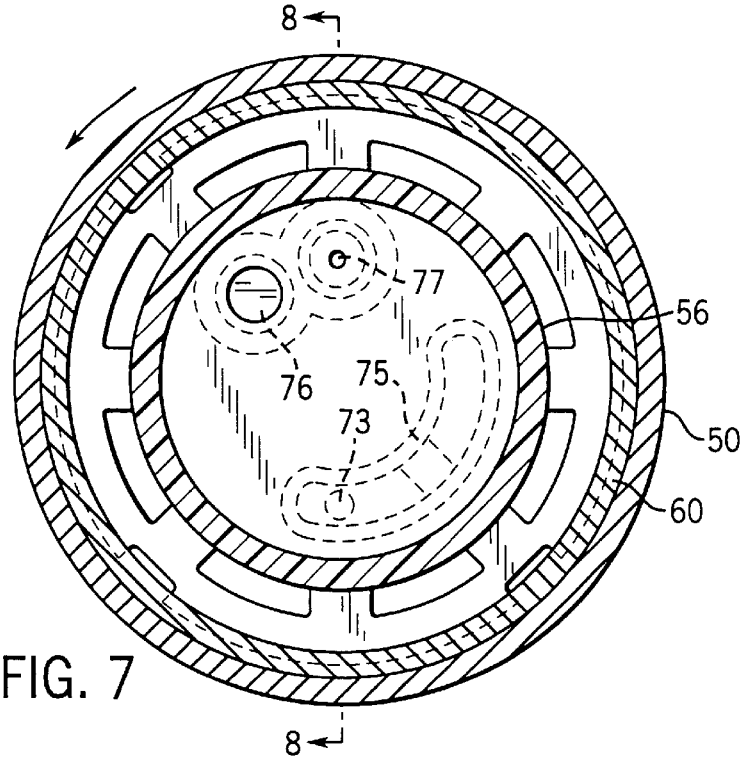
FIG. 7 is a view similar to FIG. 4, but with parts shown at a different rotational position.
Figure 8:
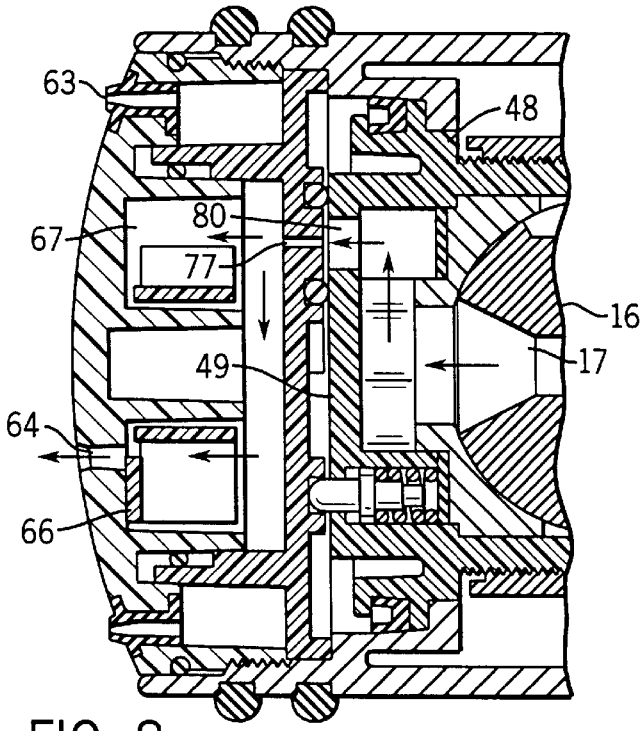
FIG. 8 is a sectional view taken along line 8—8 of FIG. 7.

FIGS. 7 and 8 represent one phase of operation of the shower head 10. This is the passage of water out through the centrally located nozzles 64. In this instance, water passes in through the passage 17 of the ball joint 16 and against the end wall 49 of inlet member 48. As shown by the directional arrows, water will flow to the passage 80 of inlet member 48 and into the small passage 77. From there, it will enter the chamber 67 and exit the nozzles 64. As the small passage will restrict the flow of water into chamber 67, it will not be of sufficient force to rotate the impeller 66. In order to effect rotation of the impeller 66, the diverter 56 will be rotated so that passage 80 of inlet member 48 will be orientated with the larger passage 76 in the diverter. This will effect rotation of the impeller.

Figure 9:
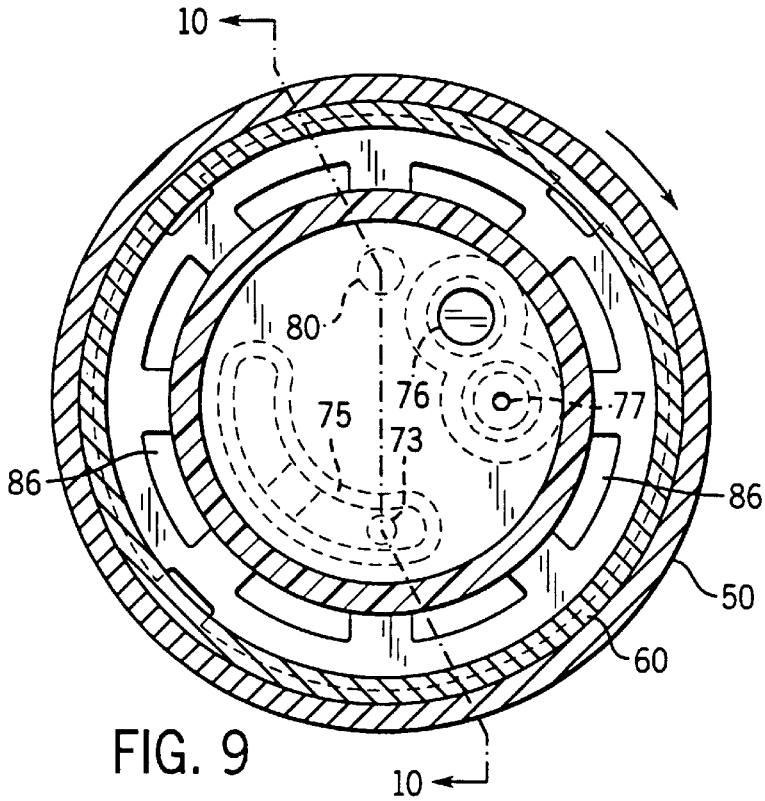
FIG. 9 is a view similar to FIG. 7, albeit illustrating yet another position of the shower head.
Figure 10:
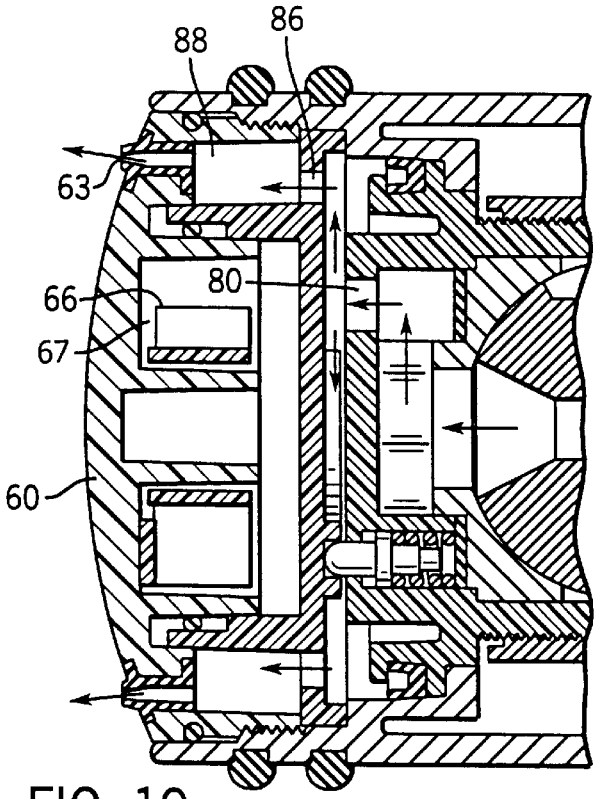
FIG. 10 is a sectional view taken along line 10—10 of FIG. 9.

FIGS. 9 and 10 illustrate the passage of water to the outerly disposed nozzles 63. In this instance, the passage 80 is located away from either large passage 76 or small passage 77. Water will then flow around these passages and be sealed therefrom by the seal 78. Water will flow against the wall 49 and thereover until it reaches the passages 86 in the diverter 56. From there it flows into passages 88 in the face plate 60.

It should be noted that the nozzles 63 are preferably composed of a flexible and resilient material so as to provide a nozzle which can be flexed and thus prevent clogging.

A second embodiment of the invention is shown in the shower head 110 in FIGS. 11–20. Shower head 110 comprises an inlet assembly 112 and an outlet assembly 114. A user of the shower head 110 can adjust the spray volume, and select among three different spray patterns by rotating the outlet assembly 114 with respect to the inlet assembly 112, as will be described.

The inlet assembly 112 has a ball joint 115 which includes an internal threaded member 117 adapted to mate with a pipe extending from a shower enclosure. The ball joint 115 has an aperture 134 extending therethrough with a conventional inlet screen 135. The inlet assembly includes a hollow cylindrical inlet cap 116 with an aperture 118 at one end through which the ball joint 115 passes and a larger diameter 119 at the other end adjacent the outlet assembly 114.

The outlet assembly 114 includes an annular outer shell 120 having two grip rings 121 for rotational purposes. The end of the outlet assembly 114 which is remote from the inlet assembly 112 has a large circular opening within which several components are concentrically located. These components create the different spray patterns. The first of these components is a channel ring 122 which abuts the inner surface of the outer shell 120. A ring shaped diffuser 124 is placed between the distributor 128 and the outer shell 120, and provides for nozzles 125.

Figure 12:
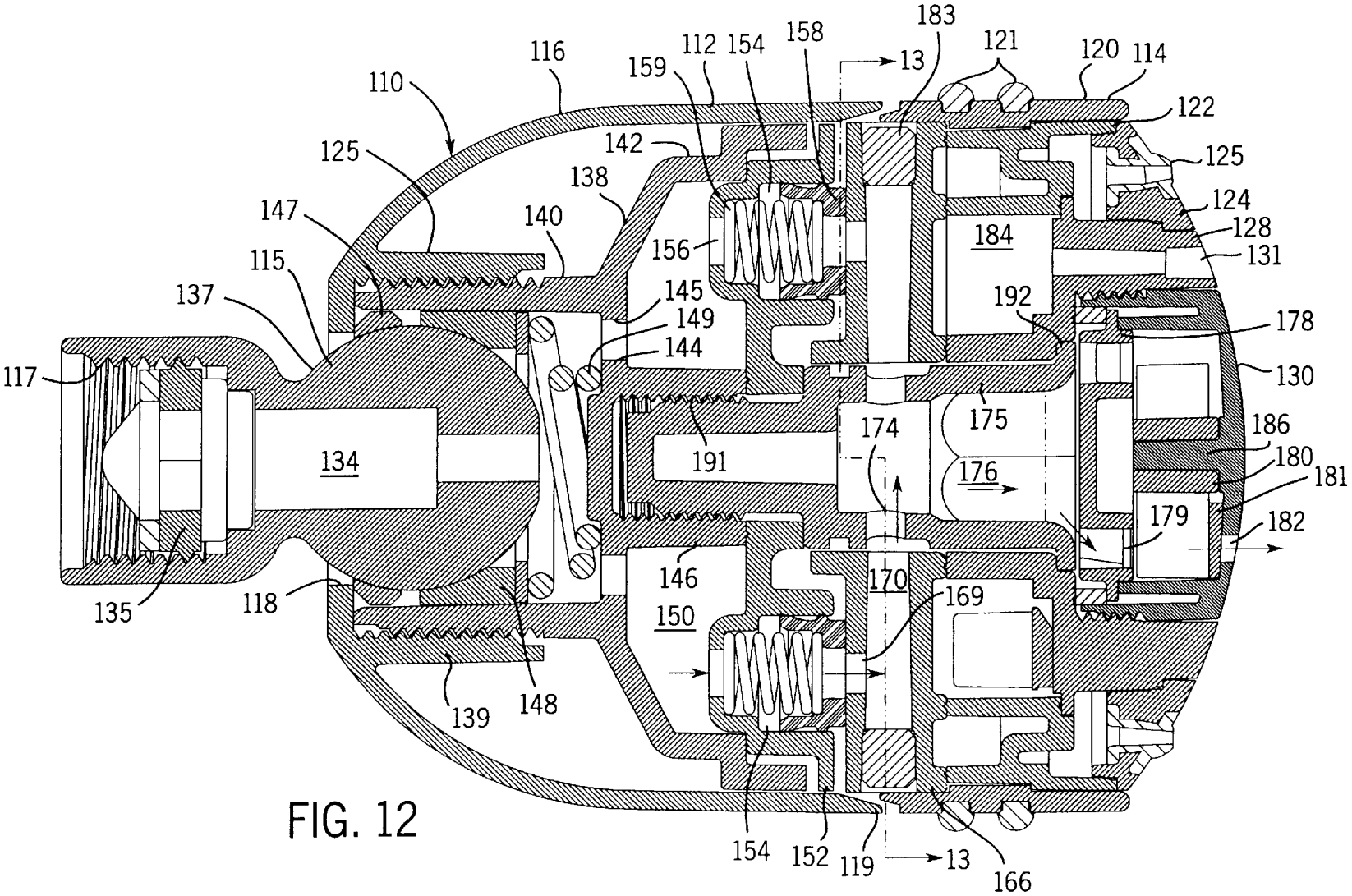
FIG. 12 is a longitudinal sectional view of the shower head shown in FIG. 11.

As seen in FIG. 12, an inlet housing 138 has a tubular portion 140 that threads onto a tubular projection 139 inside the inlet cap 116. The inlet housing 138 has a hollow, conical section 142 extending from the tubular portion 140 and an internal wall 144 which extends across the junction of the tubular portion 140 to the conical section 142. The internal wall 144 has a number of apertures 145 extending therethrough. A tubular member 146 extends from the wall inside the conical section 142 defining each chamber 150 therebetween.

The ball joint 115 extends through the aperture 118 in the inlet cap 116 with a sphere 137 of the ball joint located inside the tubular portion 140 of the inlet housing 138. The sphere 137 is larger than the aperture 118 so that it will not fit therethrough. A resilient washer 147 is placed between the sphere 137 in the inlet cap 116 to prevent contact with and damage to the surface finish of the sphere. An annular gasket 148 is positioned within the tubular portion 140 between the ball joint 115 and the wall 144 and is biased against the ball by the compression spring 149. This assembly of components within the tubular portion 140 of the inlet housing 138 forms a watertight pivoted coupling for connecting the showerhead 110 to a water supply pipe. The water flows from the ball joint 115 into the tubular portion 140 and passes through aperture 145 into chamber 150 within the conical section 142.

Chamber 150 is closed by an annular head plate 152 which extends across the interior of the inlet housing 138 abutting the exposed end of the conical section 142 and the tubular member 146 in a manner which provides a fluid tight seal there between. The head plate 152 also forms a wall of the inlet assembly 112 which abuts the outlet assembly 114. Two cylindrical cavities 154 are formed in the outer surface of the head plate 152 and have aperture 156 to which the chamber 150 communicates with each cavity. A separate annular inlet seal 158 lies within each cavity 154 and is biased outward by a compression spring 159.

As shown in FIG. 16, another cavity 160 is provided in the head plate 152 in a radially spaced relationship to the two cavities 154. A ball bearing 162 is located within the cavity 160 and is biased outwardly therefrom by the spring 164. The ball bearing 162 rides against a selector plate 166 which forms an inner wall of the outlet assembly 114.

As previously noted, three different spray patterns of the shower head are selected by rotating the outlet assembly 114 with respect to the inlet assembly 112. At the centerpoint of the rotation of travel, where one of the three spray patterns is selected, the ball bearing 162 falls into a depression 163 providing a detent as a sensory feedback to the user when the spray head is in this position. The other two spray patterns are selected by rotating the assembly 114 into that extreme positions in opposite directions as will be described subsequently. Rotational stops strike the walls which form the cavities 154 and thereby define each of these extreme positions.

Figure 13:
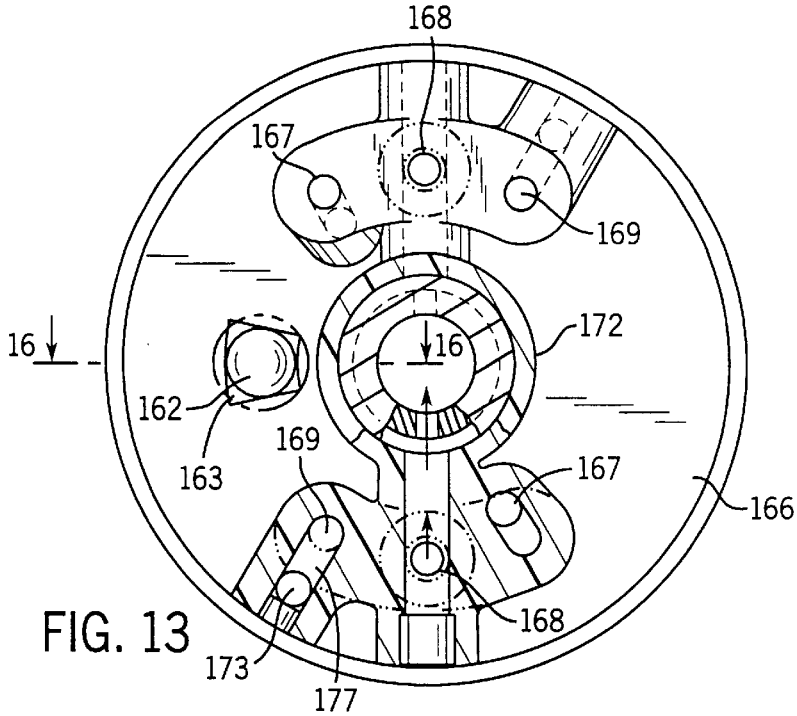
FIG. 13 is a view taken along line 13—13 of FIG. 12.
Figure 14:
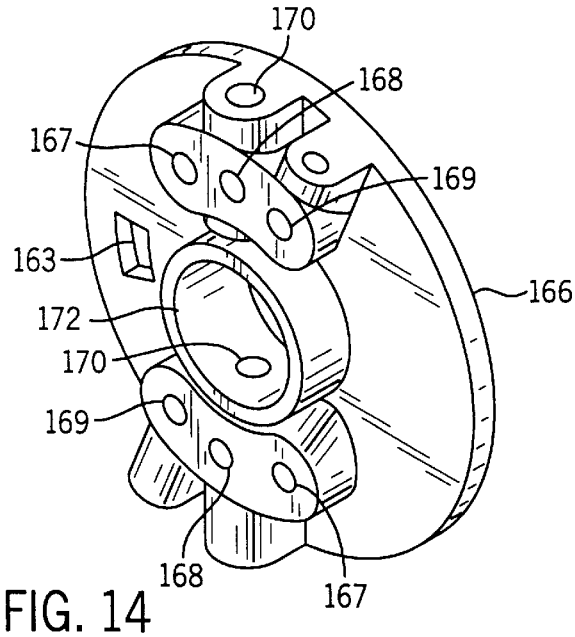
FIG. 14 is a perspective view of a selector plate of the shower head.
Figure 15:
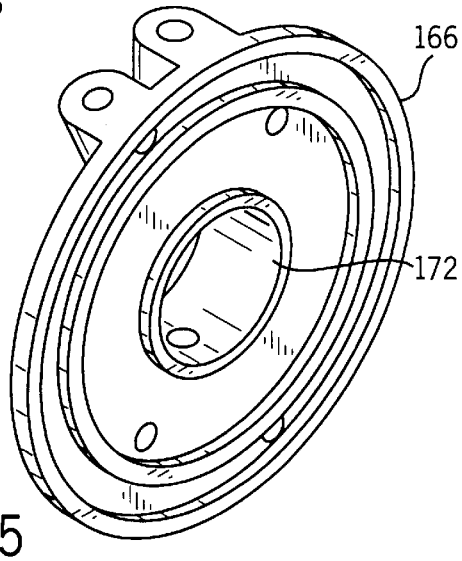
FIG. 15 is a second perspective view of the selector plate of FIG. 14.

With reference to FIGS. 13–15, the selector plate 166 of the outlet assembly 114 has two sets of three outlet apertures 167, 168 and 169 extending therethrough. Each set of apertures is positioned to communicate with one of the rubber inlet seals 158 upon rotation of the outlet assembly. FIGS. 12 and 13 illustrate a first water passage through the selector plate 166. One of the selector plate apertures 168 communicates with a radially transversed passage 170 on each side of the annular selector plate 166. The outer most ends of the passages 170 are sealed by plugs 183. The inner most ends open into a central aperture 172.

The passages 170 permit water entering the selector plate through apertures 168 to flow toward the central aperture 172 by means of a passage 170. From there water will enter through the apertures 174 in the central post 175 having the channel 176. From there water flows past the flow director 178 and into the channel 179 where it will strike the impeller 180 which is mounted over the central post 186 of central housing 130.

As the water flows therethough, it will cause the impeller to rotate, and the impeller blade 181 to momentarily block water flow through the nozzle 182 thereby effecting a pulsation of the water. It should be noted that selector plate 166 which is remote from the inlet assembly 112 abuts and is welded or cemented to the inner ends of the channel ring 122 and the distributor 128 so as to rotate with the outlet assembly 114.

Figure 17:
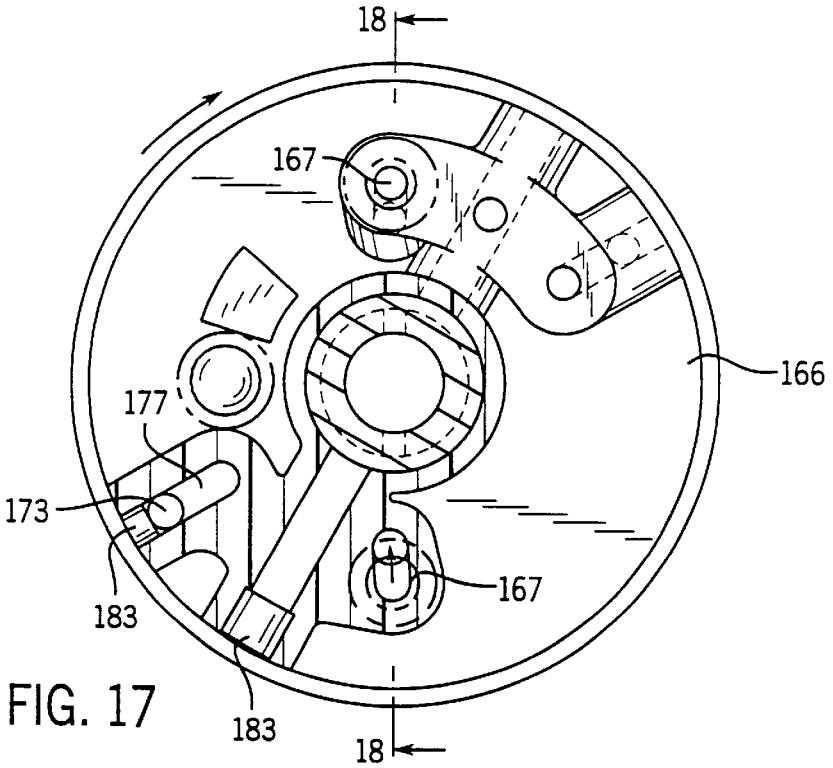
FIG. 17 is a view similar to FIG. 13, but in a rotated position.
Figure 18:
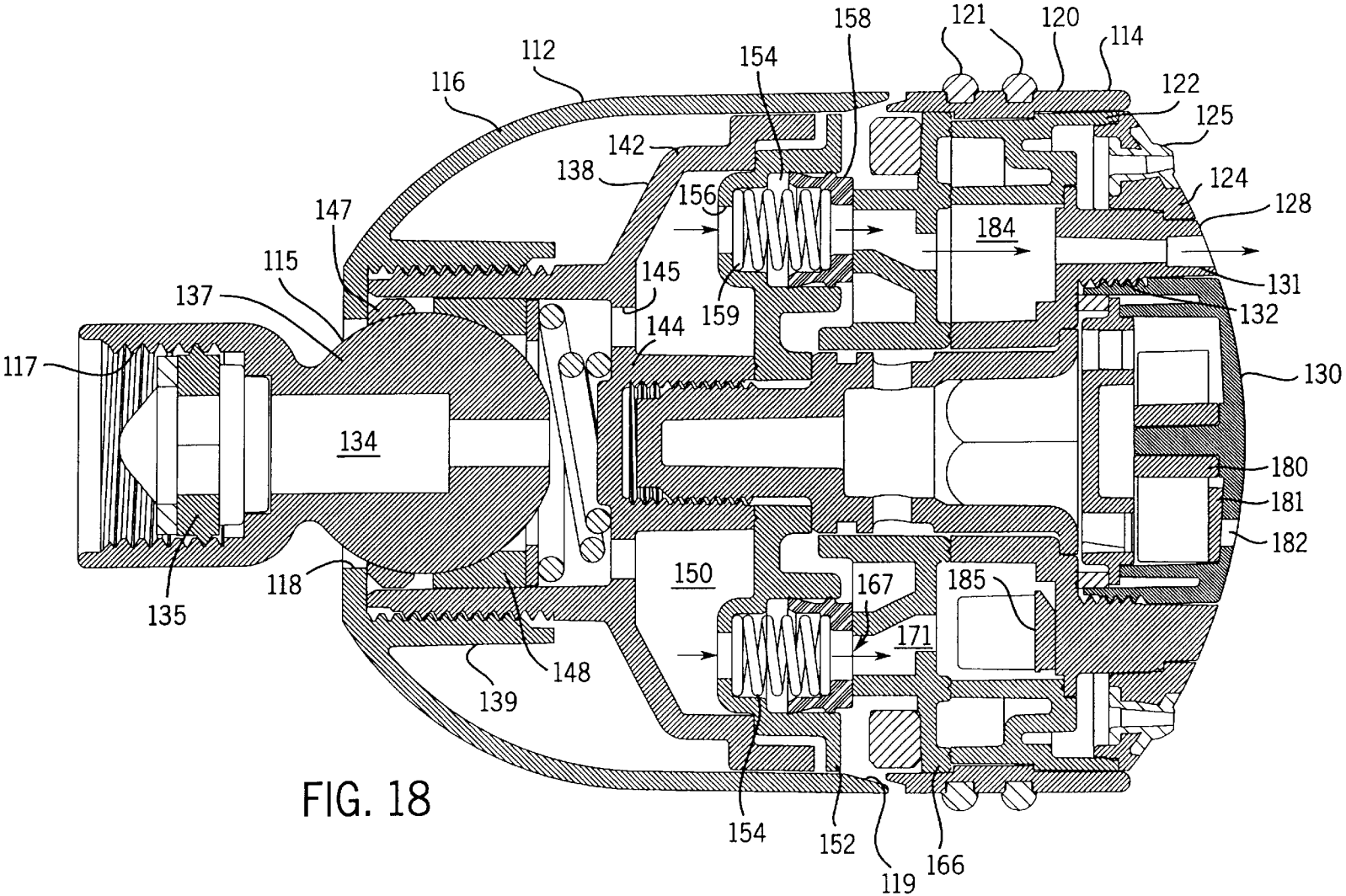
FIG. 18 is view taken along line 18—18 of FIG. 17.

FIGS. 17 and 18 represent the flow of water to the intermediate outlets 131. The flow of water from apertures 156 in head plate 152 is directed to the outlet apertures 167 in selector plate 166. From there the water flows through the passages 171 in the selector plate and into chamber 184. Chamber 184 has rotatably mounted therein the impeller 185 and the passage of water therein will effect a rotation of the impeller in the same manner as impeller 180 in chamber 165.

Figure 19:
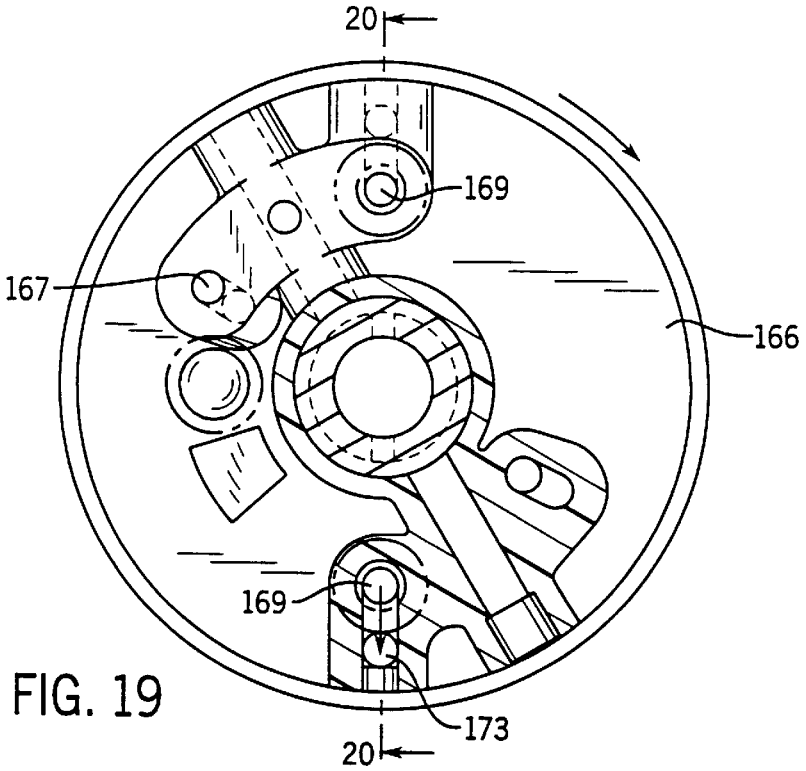
FIG. 19 is a view similar to FIG. 17, albeit showing the selector plate in yet another rotational position.
Figure 20:
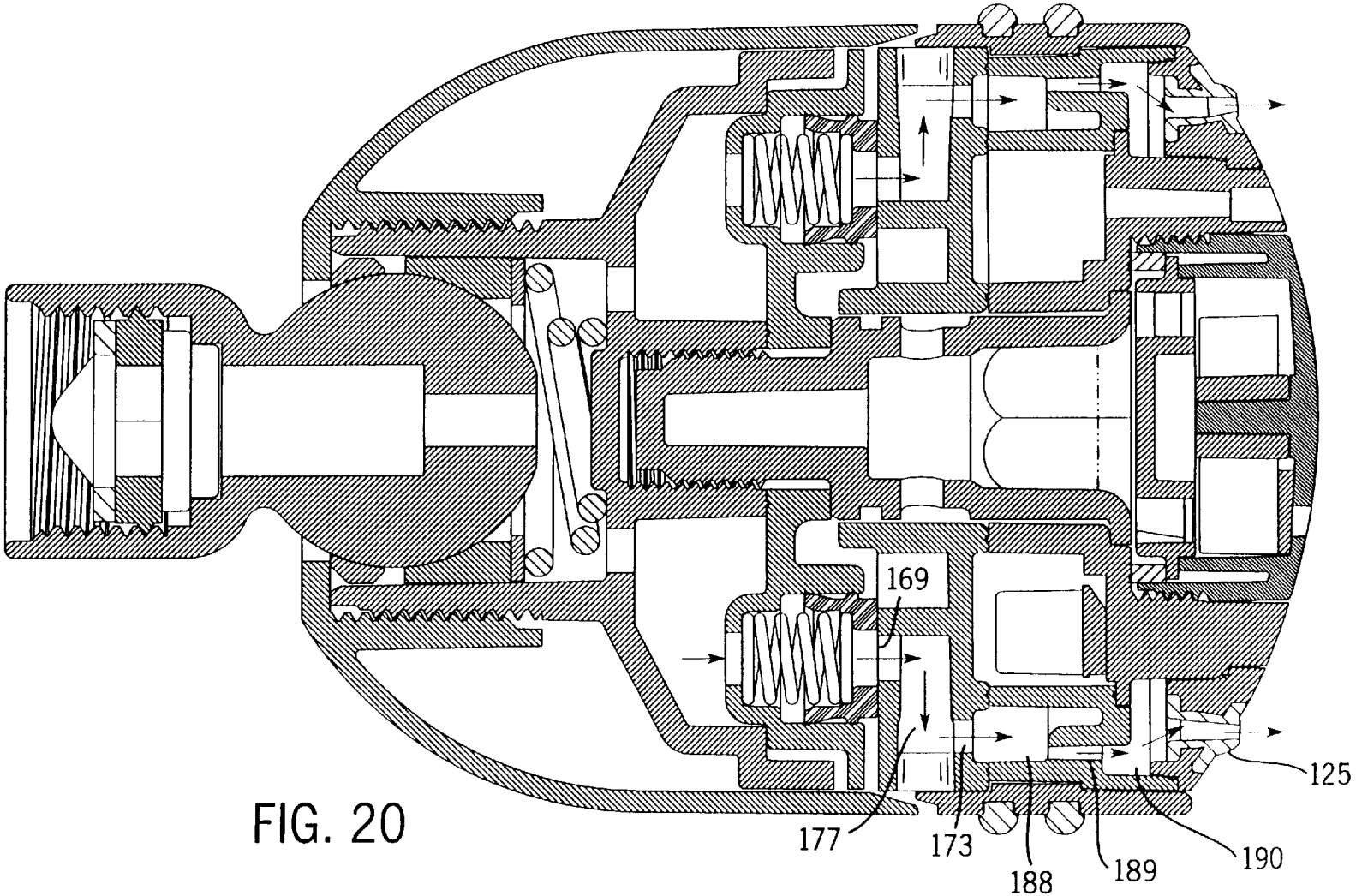
FIG. 20 is a view taken along line 20—20 of FIG. 19.

FIGS. 19 and 20 show the passage of water to the outer nozzles 125. In this instance, the selector plate 166 is positioned such that water will pass from apertures 156 in head plate 152 into aperture 169. From there it will flow through passages 177 and through outlets 173. From outlet 173 water will flow into chamber 188, through passage 189 and into chamber 190, as well as passage 190 and ultimately out through nozzles 125.

It should be noted that outlet assembly 114 is rotatably connected to inlet assembly 112 by the post member 175. A threadable connection is provided at 191 for engagement with tubular member 146. The flange 192 engaging distributor 128 provides for the rotation.

An important feature of shower head 110 is that it affords concentric pulsating spray options while also permitting regular spray aperture 182 which are centrally located as well as the outlets 131.

Figure 21:
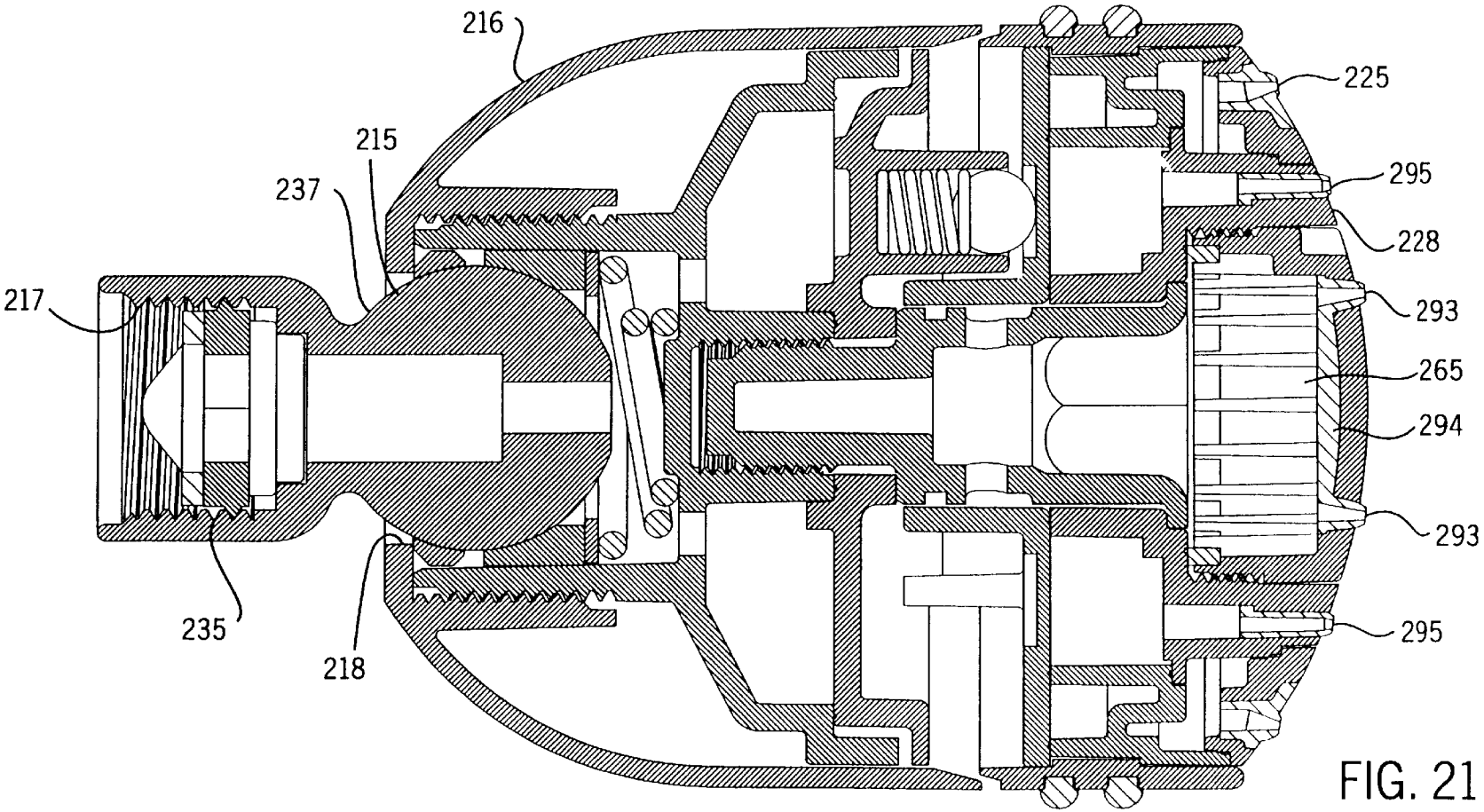
FIGS. 21 and 22 are longitudinal sectional views of a third embodiment of the present invention, in two different rotational positions.
Figure 22:
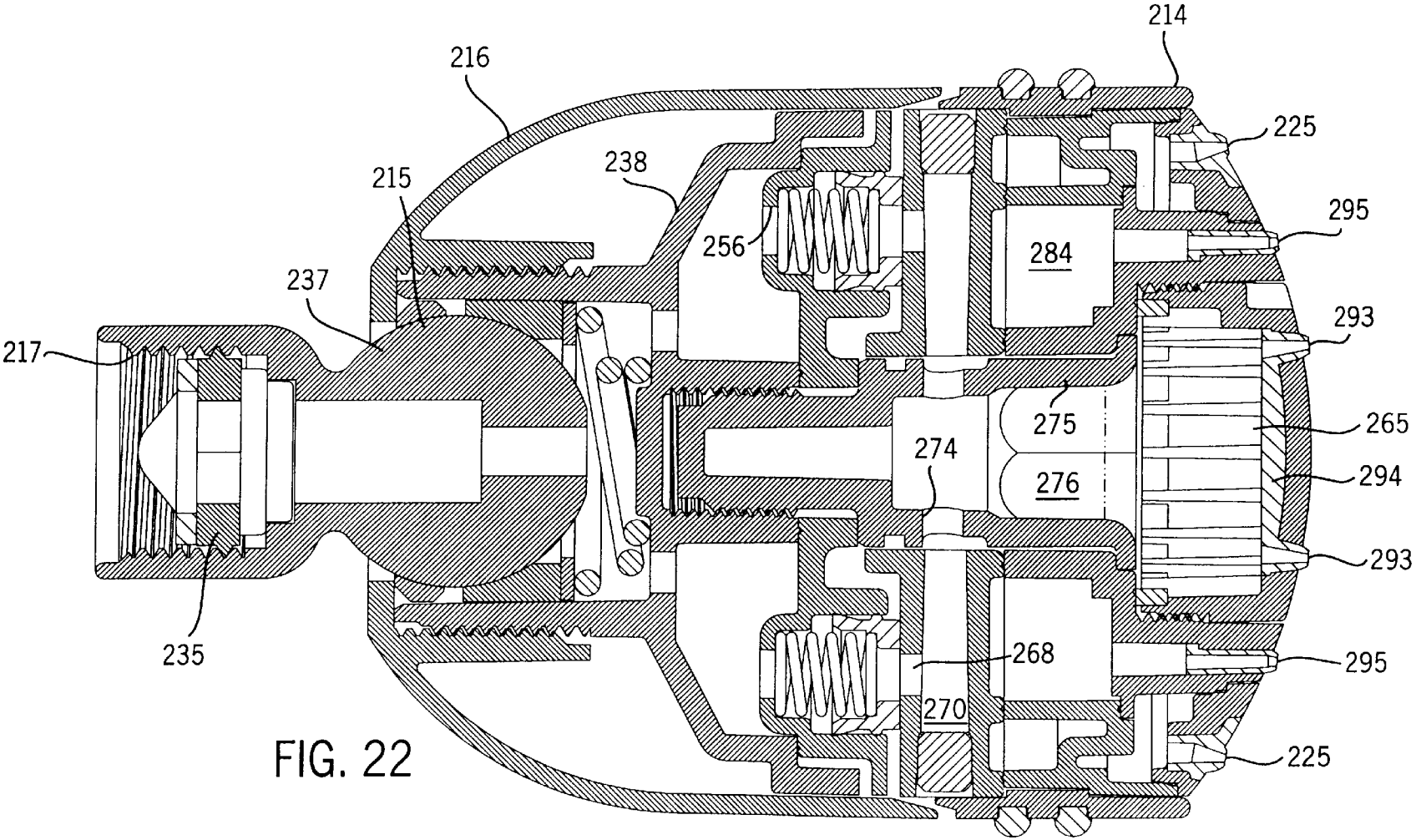
Figure 23:
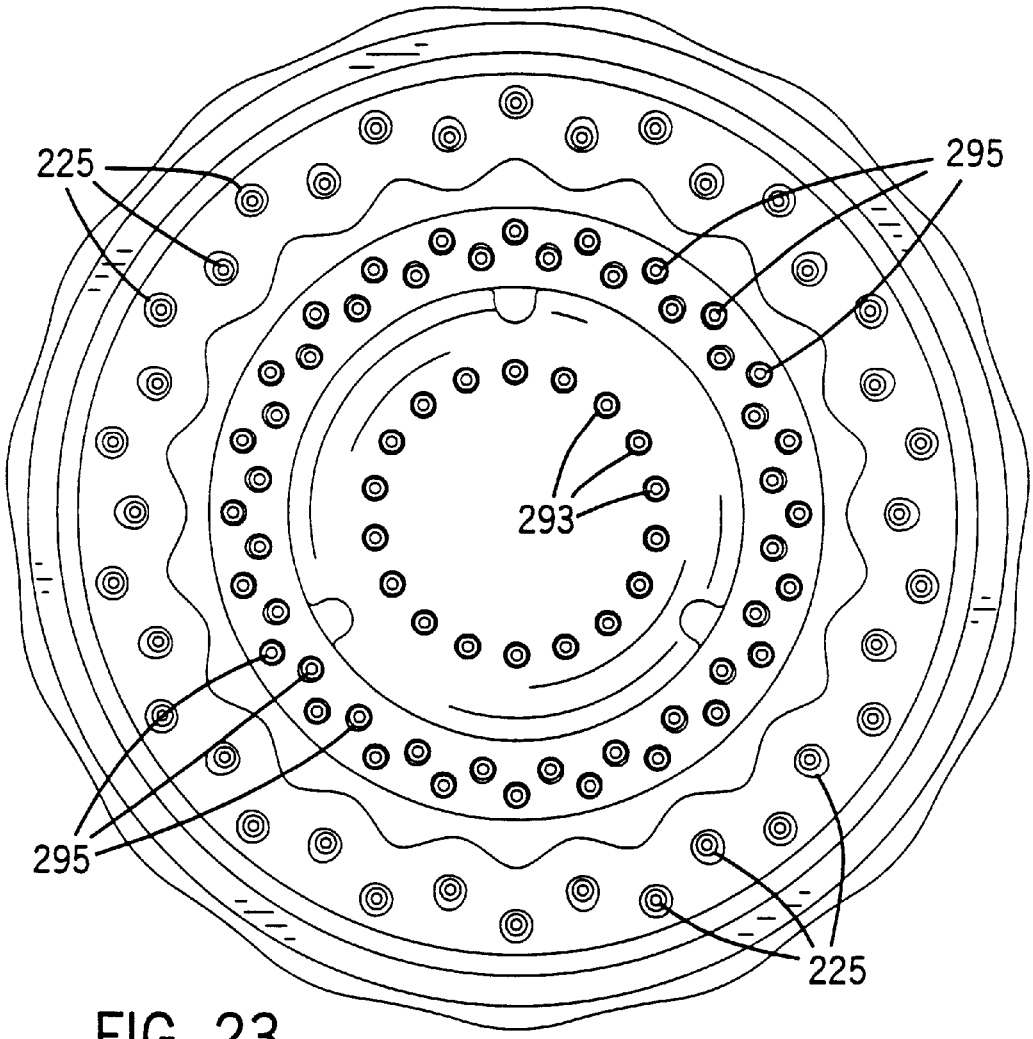
FIG. 23 is a view similar to FIG. 2, albeit of the embodiment shown in FIG. 21.

A third embodiment of a shower head is shown at FIGS. 21–23. Similar components are shown with similar numbers as in embodiment 110 except they are in the 200 series. The main difference between the two embodiments is that shower head 210 has no impellers. Instead, the flow from the central chamber 265 is out through the nozzles 293 which are joined by base member 294. Also, it will be seen that the flexible nozzles 295 are placed in distributor 228.

As may be appreciated from FIG. 23, the overall cross sectional area of the passageway holes of the radially innermost set is less than that of the second set, which in turn is less than that of the third set. Thus, for any given volume of water passing through the head water will at least in part be more forcefully expelled through the center set than the set next to that. Similarly, water expelled from the middle set will be more forceful through any given hole than water expelled from the outside holes.

INDUSTRIAL APPLICABILITY

The present invention provides shower heads with settings for varying the type of flow and force of flow through various outlets.

We claim:

1. A shower head, comprising:

an inlet assembly having a first chamber therein, a means for coupling the first chamber to a fluid supply, and an exit from the first chamber;

an outlet assembly abutting the inlet assembly and being rotatably attached thereto, the outlet assembly having:

a body having inlets positionable to communicate with the exit when the outlet assembly is rotated into different positions with respect to the inlet assembly, the body also having a discharge section in which outlets are positioned;

a face plate member connected to the body, the face plate member having three sets of fluid passageways therethrough, the first set being a radially inward set, the third set being a radially outward set, and the second set being a radially middle set, the face plate member having a central impeller housing defining the first set of fluid passageways and an inwardly extending post adjacent its center;

a first rotatable impeller rotatably mounted about the post of the impeller housing and positioned between a first outlet and the first set of passageways; and a second rotatable impeller positioned between a second outlet and the second set of passageways;

wherein when an outlet of the body is in communication with the first set and water is passed through the shower head, the first impeller will spin;

wherein when an outlet of the body is in communication with the second set and water is passed through the shower head, the second impeller will spin;

wherein when an outlet of the body is in communication with the third set, water can pass through the shower head through the third set; and wherein the first arid second impellers provide pulsed flow at different rates for a given flow rate through the inlet assembly;

wherein flexible nozzles are positioned in the third set of passageways.

2. The shower head of claim 1, wherein the head is connected to a hand held shower handle.

* * * * *

UNITED STATES PATENT AND TRADEMARK OFFICE

CERTIFICATE OF CORRECTION

PATENT NO. : 6,533,194 B2
DATED : March 18, 2003
INVENTOR(S) : Windsor B. Marsh et al.

It is certified that error appears in the above-identified patent and that said Letters Patent is hereby corrected as shown below:

Column 8,
Line 39, change “arid” to -- and --.

Signed and Sealed this

Twelfth Day of August, 2003

JAMES E. ROGAN
*Director of the United States Patent and Trademark Office*